United States Patent [19]

Berriman et al.

[11] 4,198,357

[45] Apr. 15, 1980

[54] FLOW DEVICE AND METHOD

[75] Inventors: Lester P. Berriman, Irvine; Robert D. Englert, Corona del Mar; Kenneth R. Armstrong, Lakewood, all of Calif.

[73] Assignee: Dresser Industries, Inc., Dallas, Tex.

[21] Appl. No.: 967,699

[22] Filed: Dec. 8, 1978

[51] Int. Cl.[2] ..... F02M 9/06

[52] U.S. Cl. ..... 261/44 B; 138/39; 138/45; 261/DIG. 78; 261/78 R

[58] Field of Search ..... 261/DIG. 78, 62, 78 R, 261/44 B; 138/39, 44, 45; 239/590; 137/15.1

[56] References Cited

U.S. PATENT DOCUMENTS

| | | | |
|---|---|---|---|
| Re. 28,090 | 7/1974 | Gluntz | 138/44 |
| 2,143,477 | 1/1939 | Dillon et al. | 138/39 |
| 2,573,834 | 11/1951 | Davidson | 138/39 |
| 2,772,620 | 12/1956 | Ferri | 137/15.1 |
| 3,282,297 | 11/1966 | Bauer | 138/39 |
| 3,778,038 | 12/1973 | Eversole et al. | 261/DIG. 78 |
| 3,965,221 | 6/1976 | Englert et al. | 261/DIG. 78 |
| 4,058,141 | 11/1977 | Hasinger et al. | 138/39 |

OTHER PUBLICATIONS

Neumann et al., "High-Efficiency Supersonic Diffusers", Journal of the Aeronautical Science, pp. 369-374, 6-1951.

*Primary Examiner*—Tim R. Miles

*Attorney, Agent, or Firm*—Connolly and Hutz

[57] ABSTRACT

A flow device and method delivers a gaseous medium to utilization equipment having variable pressure conditions at its intake. A gaseous medium intake zone connects with structure defining a variable area throat zone for constricting the flow of the gaseous medium to increase the velocity thereof to sonic. The throat zone is adjustably varied in correlation with operating demands imposed upon the utilization equipment. Wall structure downstream from the throat zone provides a gradually diverging zone for efficiently recovering the kinetic energy of the high velocity gaseous medium as static pressure. Through such efficient recovery the velocity of gaseous medium through the throat zone is sonic over a wide range of pressure conditions at the intake of the utilization equipment. A flow splitter is spaced from the adjustable throat zone and the splitter is arranged to divide the downstream end portion of gradually diverging zone into multiple zones of reduced divergence. The multiple zones have reduced divergence compared to the divergence of the upstream end portion of the gradually diverging zone and also the downstream end portion if the splitter were not present.

10 Claims, 3 Drawing Figures

FLOW DEVICE AND METHOD

BACKGROUND OF THE INVENTION

The present invention relates to a flow device and method, and more particularly to a flow device and method for lowering the exit velocity of a gaseous medium flowing through the device by increasing the divergence of the wall structure at the exit end of the device while preventing unstable flow conditions.

U.S. Pat. No. 3,778,038 granted Dec. 11, 1973, explains a method and apparatus for producing a uniform combustible mixture of air and minute liquid fuel droplets for delivery to the intake manifold of an internal combustion engine. This apparatus includes an intake air zone connected to a variable area throat zone for constricting the flow of air to increase its velocity to sonic. Liquid fuel is introduced into the air stream to minutely divide and uniformly entrain fuel as droplets in the air flowing through the throat zone. Wall structure downstream from the throat zone is arranged to provide a gradually diverging zone for efficiently recovering a substantial portion of the kinetic energy of the high velocity air as static pressure. Such efficient conversion enables the maintenance of sonic velocity air through the throat zone over substantially the entire operating range of the engine to which the air-liquid fuel mixture is supplied.

As further explained in the above U.S. patent, during flow conditions when the pressure ratio across the apparatus is high, a shock occurs downstream from the throat zone. As the pressure ratio increases, the shock moves down the gradually diverging zone and further away from the throat zone. With even higher pressure ratios across the apparatus, the shock moves further down the gradually diverging zone. After shock under any conditions there is a tendency for the flow to separate from the walls of the gradually diverging zone. Usually the flow simply reattaches to the walls but when the shock is far down the gradually diverging zone, there is not sufficient time for such reattachment and an excessively high velocity jet is formed.

The above U.S. patent also discloses that the device functions to control the mass flow of air being supplied to the engine since the air flow is maintained at sonic velocity through the throat zone over a wide range of engine conditions. Hence, under unvarying atmospheric conditions the mass flow rate of air being supplied to the engine is directly proportional to the cross-sectional area of the throat zone. Finally, as is apparent from the above U.S. patent, the liquid delivery means may be eliminated and the device used solely as a mass flow control for air or any gaseous medium.

The particular divergence of the wall structure downstream from the throat zone is extremely important in order to efficiently recover the kinetic energy of the high velocity mass as static pressure. As explained above, such efficient energy recovery enables sonic velocity at the throat zone over a wide range of downstream pressure conditions. However, the gradually diverging zone formed by the wall structure may be such that the exit velocity of the mass is excessive under the conditions mentioned above when the pressure ratio across the apparatus is high thereby causing a shock to occur far down the gradually diverging zone. Then the flow does not reattach to the walls and a high velocity jet emerges from the apparatus. In a carburetor application, for example, excessive exit velocity causes the air-fuel mixture to impinge upon the manifold floor which prevents the mixture from being delivered to the cylinders of the engine in a homogeneous state.

Utilization of a larger angle of divergence of the wall structure downstream from the throat zone causes the shock to occur much closer to the throat zone which allows reattachment of the flow to the walls before it emerges from the apparatus. The exit velocity of the mass is thereby lowered. However, such wider angles in the diverging zone may result in unstable flow at the lower end portion of that zone, particularly under conditions when the angle of divergence is quite wide and the throughput is low. Also, switching of the mass from one side to the other in the low end portion of the diverging zone may occur under the same conditions. Lower efficiency often results since some of the kinetic energy of the high velocity mass is lost to turbulence at the lower end portion of the diverging zone. Switching causes droplet conglomeration of the fuel and poor charge distribution of the mass delivered to the manifold.

SUMMARY OF THE INVENTION

Accordingly, an object of the present invention is a sonic flow device having structure that lowers the exit velocity of a gaseous medium flowing through the device while still preserving efficient recovery of the kinetic energy of the high velocity gaseous medium as static pressure.

Another object of the present invention is a method for lowering the exit velocity from a sonic flow device while maintaining efficient recovery of the kinetic energy of the high velocity mass as static pressure.

In accordance with the present invention, a device delivers a gaseous medium to utilization equipment having variable pressure conditions at its intake. The device comprises structure defining a gaseous medium intake zone connecting with a variable area throat zone for constricting the flow of the gaseous medium to increase the velocity thereof to sonic. The area of the throat zone is adjustably varied in correlation with operating demands imposed upon the utilization equipment. Wall structure downstream from the throat zone is arranged to provide a gradually diverging zone for efficiently recovering a substantial portion of the kinetic energy of the high velocity gaseous medium as static pressure. The velocity of the gaseous medium through the throat zone is sonic over a wide range of pressure conditions at the intake of the utilization equipment. The improvement comprises flow splitter structure spaced from the adjustable throat zone and arranged to divide the downstream end portion of the gradually diverging zone into multiple zones of reduced divergence. These zones have reduced divergence in reference to the upstream end portion of the gradually diverging zone and also the downstream end portion if the splitter were not present.

The flow splitter structure may comprise a single thin wall oriented in the direction of flow and arranged to divide the downstream end portion of the gradually diverging zone into two substantially equal zones. Also, the cross-sectional area of the gradually diverging zone at the upstream end of the flow splitter structure may be within the range of 1.3 to 2.3, preferably about 1.7 times the cross-sectional area of the adjustable throat zone.

The wall structure downstream from the adjustable throat zone may comprise first opposed walls each diverging at an angle of approximately 8° and second opposed walls mounted for relative movement toward and away from one another. The flow splitter structure extends perpendicular to the second opposed walls and divides the downstream end portion of the gradually diverging zone into substantially equal zones each having a reduced divergence of approximately 8° compared to the divergence of approximately 16° of the upstream end portion of the gradually diverging zone.

Liquid delivery structure may be provided for introducing liquid into the flow of the gaseous medium at or above the adjustable throat zone. In a carburetor application the gaseous medium is air, the gaseous medium pressure at the entry to the intake zone is atmospheric, and the delivery structure introduces liquid fuel.

A method is also provided for delivering a gaseous medium at a controlled mass flow rate to utilization equipment having variable pressure conditions at its intake. It is significant that such method includes the step of splitting the flow of the gaseous medium downstream and spaced from the adjustable throat zone to thereby divide the downstream end portion of the gradually diverging zone into multiple zones of reduced divergence compared to the divergence of the upstream end portion of the gradually diverging zone. In the method of the invention the flow of the gaseous medium downstream and spaced from the throat zone is preferably split into two substantially equal zones. Liquid may be introduced into the flow of the gaseous medium at or above the variable area throat zone, and for carburetion applications the liquid introduced is fuel and the gaseous medium is air.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which.

DETAILED DESCRIPTION OF THE INVENTION

Figure 1:
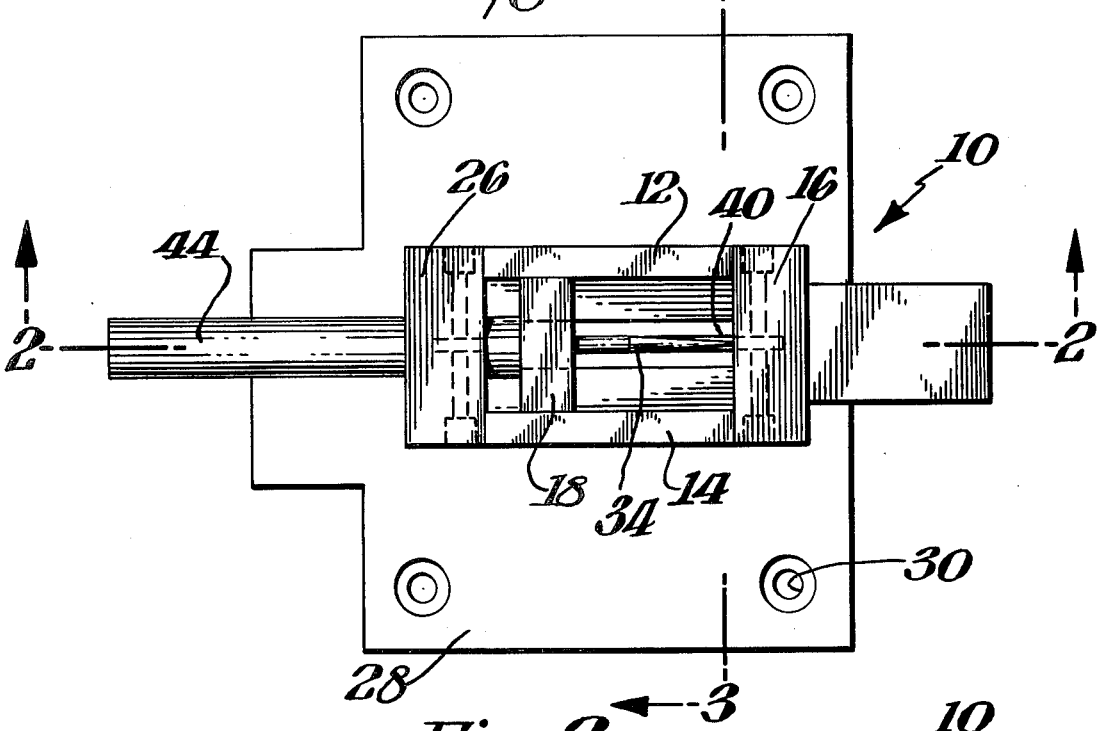
FIG. 1 is a top plan view of a fluid flow device, according to the present invention.
Figure 2:
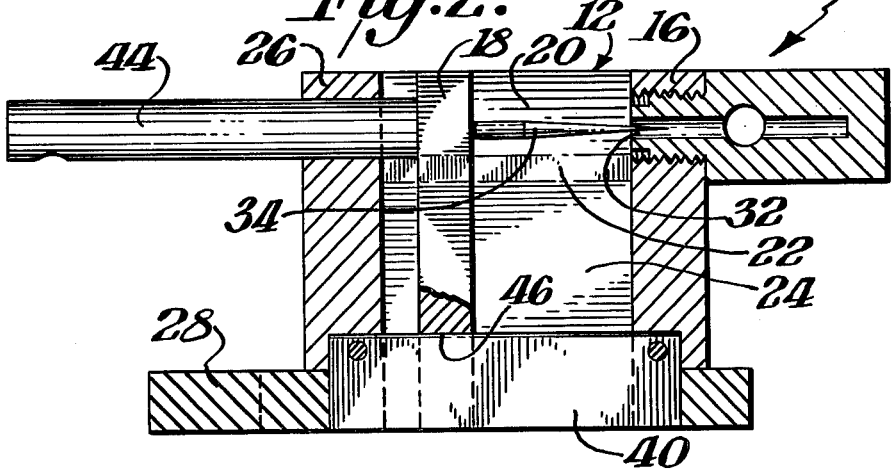
FIG. 2 is a sectional view taken along line 2—2 of FIG. 1.
Figure 3:
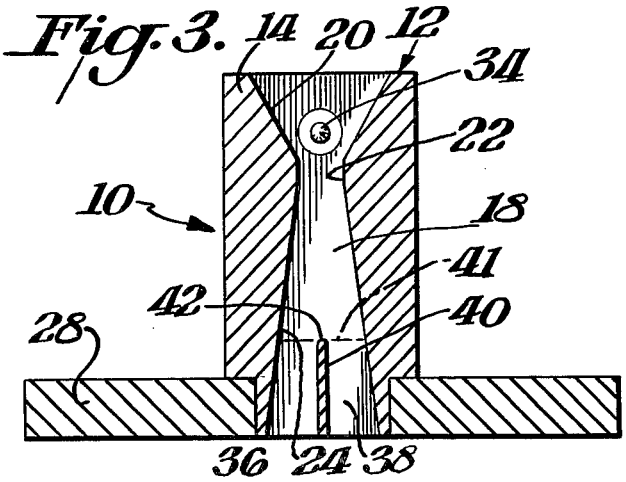
FIG. 3 is a sectional view taken along line 3—3 of FIG. 1.

Referring in more particularity to the drawings, FIGS. 1-3 illustrate a fluid flow device 10 for mixing and modulating liquid fuel and air in the production of a combustible air-liquid fuel mixture. While the device 10 is described for use in producing an air-fuel mixture, such device is equally capable of mixing and modulating other gaseous mediums besides air and other liquids besides fuel. Also, the liquid introduction structure of the device 10 may be eliminated and the so-modified device used as a mass flow control for a gaseous medium alone.

Generally, the device 10 illustrated in FIGS. 1-3 comprises an elongated housing with a central flow passageway therein. The passageway is defined by a pair of opposite stationary large jaws 12,14 and a pair of opposite small members in the form of slabs 16,18. Slab 18 moves toward and away from stationary slab 16 to vary the mass flow of air passing through the passageway. Specifically, the passageway includes a gradually converging air entrance zone 20, a variable area throat zone 22 and a gradually diverging downstream zone 24. The stationary jaws 12,14 together with the slab 16 and housing end wall 26 are secured to a rectangular base plate 28 having openings 30 for securing the device 10 to the intake manifold (not shown) of an internal combustion engine.

The inside walls of the opposite stationary large jaws are shaped to define a venturi cross-section with the small slabs 16,18. This venturi cross-section includes the air entrance zone 20, the throat zone 22, and the gradually diverging downstream zone 24. Atmospheric air enters the mixing and modulating device 10 at the air entrance zone 20, and the air is accelerated to sonic velocity at the throat zone 22. Liquid fuel is introduced into the high velocity air stream at a fuel opening 32 upstream from the throat zone 22. The fuel opening is located in the stationary slab 16, and a fuel source (not shown) is connected to the opening. A tapered fuel metering rod 34 mounted for movement with the movable slab 18 is received within the fuel opening 32 to vary the rate of fuel delivered into the high velocity air stream.

Preferably, the small slabs 16,18 diverge about one or two degrees in the gradually diverging downstream zone 24. This expedient functions to prevent the zone 24 from acting like a choke under low flow conditions.

The sonic velocity air-liquid fuel mixture passes from the throat zone 22 into the gradually diverging downstream zone 24 where the kinetic energy of the high velocity air and fuel is efficiently recovered as static pressure. Such conversion enables the maintenance of sonic velocity air and fuel flow through the throat zone 22 over substantially the entire operating range of the engine. Thus, sonic velocity is achieved at the throat zone even at very low manifold vacuum levels.

As shown best in FIG. 3, the downstream end portion of the gradually diverging zone 24 is divided into multiple zones 36,38 by flow splitter structure 40. The splitter 40 is spaced from the adjustable throat zone so that the cross-sectional area of the diverging zone 24 at the upstream end 42 of the splitter (plane 41) is within the range of 1.3 to 2.3 times the cross-sectional area of the adjustable throat zone 22, preferably about 1.7. As is clear from the drawings, the flow splitter comprises a thin wall oriented in the direction of flow and arranged to divide the downstream end portion of the gradually diverging zone 24 into two substantially equal zones 36,38.

The preferred location of the splitter 40 at an area ratio of 1.7 relative to the adjustable throat zone was arrived at through flow tests. If the splitter is extended upwardly in the direction of the throat so that the cross-sectional area of the diverging zone at the upper end of the splitter is less than 1.3 times the cross-sectional area of the throat, energy recovery is poor and the flow is unstable. Also, if the splitter is located further down the throat so that the cross-sectional area of the diverging zone at the upper end of the splitter is more than 2.3 times the cross-sectional area of the throat, energy recovery is poor and the flow is unstable causing more flow on one side of the splitter than the other.

The function of the splitter 40 is to reduce the exit velocity of the mass flowing through the device 10 by allowing the divergence of the zone 24 to be increased while preserving efficient energy recovery and thereby maintaining sonic flow at the adjustable throat zone over a wide range of downstream pressure conditions.

This is accomplished by utilizing a larger angle of divergence immediately downstream from the throat zone whereby that zone expands more rapidly. Hence, when the pressure ratio across the device 10 is high, the more rapidly expanding diverging zone causes the flow to shock at a location much closer to the throat zone than possible with less divergence. Shock causes the flow to separate from the walls of the diverging zone but sufficient wall structure remains downstream from the shock location and the flow then reattaches to that wall structure. However, by expanding the diverging zone more rapidly, under certain conditions unstable flow would ordinarily occur in the downstream end portion of the gradually diverging zone where the mass may separate from the walls defining the diverging zone. Also, switching of the mass from one wall in the downstream end portion of the diverging zone to an opposite wall is caused by too wide an angle in the diverging zone. These phenomena lower the efficiency of the diverging zone 24 in recovering kinetic energy as static pressure since the unstable flow and switching cause loss of kinetic energy to turbulence. However, by incorporating the splitter 40 as described above, unstable flow and switching are eliminated since the mass flows through the zones 36,38 of reduced divergence.

For example, let us assume that a gradually diverging zone of 8° is optimum for efficient energy recovery in the particular embodiment shown in the drawing. In the device 10 the portion of the jaws 12 and 14 forming the diverging zone 24 would then be provided with approximately a 4° angle of divergence. Efficient energy recovery would be provided but the exit velocity would be excessive under the conditions noted above when the pressure ratio across the device 10 is high. Widening the diverging zone 24 would lower the exit velocity but destroy the geometry necessary for efficient energy recovery, particularly at the lower end portion of that zone. However, the portions of the jaws 12,14 forming the diverging zone 24 may be widened to a divergence of about 8° and the splitter 40 utilized. In such case the exit velocity is substantially reduced due to doubling the divergence of the zone 24 while efficient energy recovery is preserved since each half of the mass is confined between the splitter and one of the jaws. Hence, all of the mass flows through the zones 36,38 of reduced divergence of approximately 8° in the example.

The mass flow of air passing through the device 10 is primarily governed by the position of the movable slab 18 relative to the stationary slab 16. Movement of the slab 18 varies the cross-sectional area of the throat zone, and under sonic conditions such variation is accompanied by an equal variation in the mass flow of air.

A rod 44 extending through an opening in the end plate 26 is secured to the outside surface of the movable slab 18. This rod is under the control of throttle linkage (not shown), and the cross-sectional area of the throat zone is varied by moving the slab 18 in direct response to operating demands imposed upon the engine to which the device 10 is attached. The slab 18 has a lower slotted portion 46 that fits over the splitter 40, as shown best in FIG. 2. The splitter 40 is arranged perpendicular to the slabs 16,18 and the slab 18 moves relative to the splitter to modulate the flow.

The device 10 illustrated in FIGS. 1–3 also provides a combustible air-liquid fuel mixture having a substantially constant air-to-fuel ratio. This feature forms no part of the present invention but is explained in detail in U.S. Pat. No. 3,965,221, granted June 22, 1976. Additionally, while a single splitter has been specifically shown, multiple splitters may also be utilized. Finally, splitters of the type herein shown and described may be used in other geometries such as one in which slabs similar to 16,18 are stationary and jaws similar to 12,14 move toward and away from one another, for example. In such case the splitter 40 is merely anchored between the stationary slabs while the configured jaws move toward and away from each other and the splitter.

What is claimed:

1. In a device for delivering a gaseous medium to utilization equipment having variable pressure conditions at its intake comprising, in combination, means defining a gaseous medium intake zone connecting with means defining a variable area throat zone for constricting the flow of the gaseous medium to increase the velocity thereof to sonic, means for adjustably varying the area of the throat zone in correlation with operating demands imposed upon the utilization equipment, wall means downstream from the throat zone arranged to provide a gradually diverging zone for efficiently recovering a substantial portion of the kinetic energy of the high velocity gaseous medium as static pressure whereby the velocity of the gaseous medium through the throat zone is sonic over a wide range of pressure conditions at the intake of the utilization equipment, the improvement comprising flow splitter means spaced downstream from the adjustable throat zone and arranged to divide the downstream end portion of the gradually diverging zone into multiple zones of reduced divergence.

2. The combination of claim 1 in which the flow splitter means comprises a single thin wall oriented in the direction of flow and arranged to divide the downstream end portion of the gradually diverging zone into two substantially equal zones.

3. The combination of claim 2 in which the cross-sectional area of the gradually diverging zone at the upstream end of the flow splitter means is within the range of 1.3 to 2.3 times the cross-sectional area of the adjustable throat zone.

4. The combination of claim 2 in which the wall means downstream from the adjustable throat zone comprises first opposed walls each diverging at an angle of approximately 8° and second opposed walls mounted for relative movement toward and away from one another, the flow splitter means extending perpendicular to the second opposed walls for dividing the gradually diverging zone into substantially equal zones each having a reduced divergence of approximately 8°.

5. The combination of claim 1 including liquid delivery means for introducing liquid into the flow of the gaseous medium at or above the adjustable throat zone.

6. The combination of claim 5 in which the gaseous medium is air, the gaseous medium pressure at the entry to the intake zone is atmospheric, and the delivery means introduces liquid fuel.

7. In a method for delivering a gaseous medium at a controlled mass flow rate to utilization equipment having variable pressure conditions at its intake comprising the steps of flowing a gaseous medium stream from an entry point, passing the gaseous medium through a variable area throat zone to increase the velocity thereof to sonic, adjustably varying the area of the throat zone in correlation with operating demands imposed upon the utilization equipment, passing the gaseous medium immediately downstream from the variable area throat zone through a gradually diverging zone to gradually reduce the velocity thereof and efficiently recover the kinetic energy thereof as static pressure whereby the velocity of the gaseous medium through the throat zone is sonic over a wide range of pressure conditions at the intake of the utilization equipment, the improvement comprising splitting the flow of the gaseous medium downstream and spaced from the throat zone to divide the downstream end portion of the gradually diverging zone into multiple zones of reduced divergence.

8. The method of claim 7 in which the flow of the gaseous medium downstream and spaced from the throat zone is split into two substantially equal zones.

9. The method of claim 7 including the step of introducing liquid into the flow of the gaseous medium at or above the variable area throat zone.

10. The method of claim 9 in which the gaseous medium is air and liquid fuel is introduced into the flow of the air.

* * * * *